US006145710A

United States Patent [19]

Carter

[11] Patent Number: 6,145,710

[45] Date of Patent: Nov. 14, 2000

[54] METERED OUTPUT FLUID DISPENSER

[76] Inventor: Miro S. Carter, 1777 Mitchell Ct., Daytona Beach, Fla. 32124

[21] Appl. No.: 09/370,820

[22] Filed: Aug. 9, 1999

[51] Int. Cl.[7] ..... B65D 88/54

[52] U.S. Cl. ..... 222/321.9

[58] Field of Search ..... 222/321.2, 321.7, 222/321.9, 378, 385, 451, 255

[56] References Cited

U.S. PATENT DOCUMENTS 5,038,965 8/1991 Cater ..... 222/255
5,217,148 6/1993 Cater ..... 222/321

*Primary Examiner*—Kevin Shaver

*Assistant Examiner*—Thach H. Bui

[57] ABSTRACT

A metered output fluid dispenser adapted to discharge fluid during a selected section of a stroke which produces fluid discharge. The dispenser includes: a vertical hollow elongated body having a first hollow cylinder having a first diameter and an integral section defining a second hollow cylinder having a second and different diameter. A first piston is slidable throughout the length of the first cylinder and remains in continuous sealing relationship engagement with the inner wall of the first cylinder. A second piston is slidable through a selected section of the total length of the second cylinder. The second piston when traversing a selected portion of said selected section causes the dispenser to dispense fluid. The second piston is in sealing relationship with the inner wall of the second cylinder when and only when the second cylinder traverses said selected portion.

5 Claims, 5 Drawing Sheets

METERED OUTPUT FLUID DISPENSER

BACKGROUND OF THE INVENTION

Metered output fluid dispensers, and their subset, commonly referred to as pharmaceutical pump dispensers, are well known in the art. Many types of such dispensers such as disclosed in U.S. Pat. Nos. 5,217,148 and 5,279,568 employ a body having first and second interconnected cylinders having different internal diameters with first and second pistons disposed in corresponding cylinders. The first piston is vertically slidable in the first cylinder and remains continuously sealed to the inner wall of this cylinder. The second piston is vertically slidable within the second cylinder and is sealed with the second cylinder throughout the dispensing stroke.

First and second pistons in conjunction with the two body cylinders form a pump chamber whose volume determines the dispenser output. The reciprocal action of the pistons within the cylinders varies the pump chamber volume during alternate compression and suction strokes. Fluid is fed into the chamber via an inlet port and is fed out of the chamber via an outlet port. The inlet port in the aforementioned patent is formed between the second cylinder and second piston when the seal between the second piston and the second cylinder is broken at the end of the suction stroke. The outlet port is configured to open during the compression stroke only when the fluid in the dispenser reaches a predetermined pressure. The part of the compression stroke when dispensing occurs is referred to as a dispensing stroke.

These prior art dispensers employ a plurality of pump components which must be manufactured to very close tolerances in order to establish an accurate volume of the pump chamber and thus the dispenser dose.

The present invention employs new and improved fluid dispenser structures having outputs which are independent of the pump chamber volume and thus reduce the number of components whose tolerances must be critically maintained.

SUMMARY OF THE INVENTION

In accordance with the principles of this invention, metered output fluid dispensers are operated to discharge fluid during a selected section of a stroke which produces fluid discharge. Each such dispenser employs a vertical hollow elongated body having a first hollow cylinder having a first diameter and an integral section defining a second hollow cylinder having a second and different diameter.

A first piston is slidable throughout the length of the first cylinder and remains in continuous sealing relationship engagement with the inner wall of the first cylinder.

A second piston is slidable throughout a selected length of the second cylinder. This length has several portions, a selected one of which defines the dispenser output. When the second piston traverses the selected portion, the second piston is disposed in sealing engagement with the inner wall of the second cylinder and the dispenser discharges its fluid. When the second piston traverses other portions, the second piston is disposed out of engagement with the inner wall of the second cylinder and no fluid discharge can take place.

In one embodiment of the invention, the dispenser is configured with the diameter of the first cylinder being larger than the diameter of the second cylinder and disposed above the second cylinder. The discharge stroke is a down stroke performed while the pistons are displaced from the normal unactuated positions and the suction stroke is an up stroke performed as the cylinders are returned to their unactuated positions by a biasing member.

In a second embodiment of the invention, the second cylinder is disposed above the first cylinder and the dispensing stroke is an up stroke performed by the biasing member after the pistons were displaced from their normal unactuated positions. Thus, in this second embodiment, fluid is discharged during the up stroke rather than during the down stroke.

DETAILED DESCRIPTION OF PREFERRED EMBODIMENTS

Figure 1:
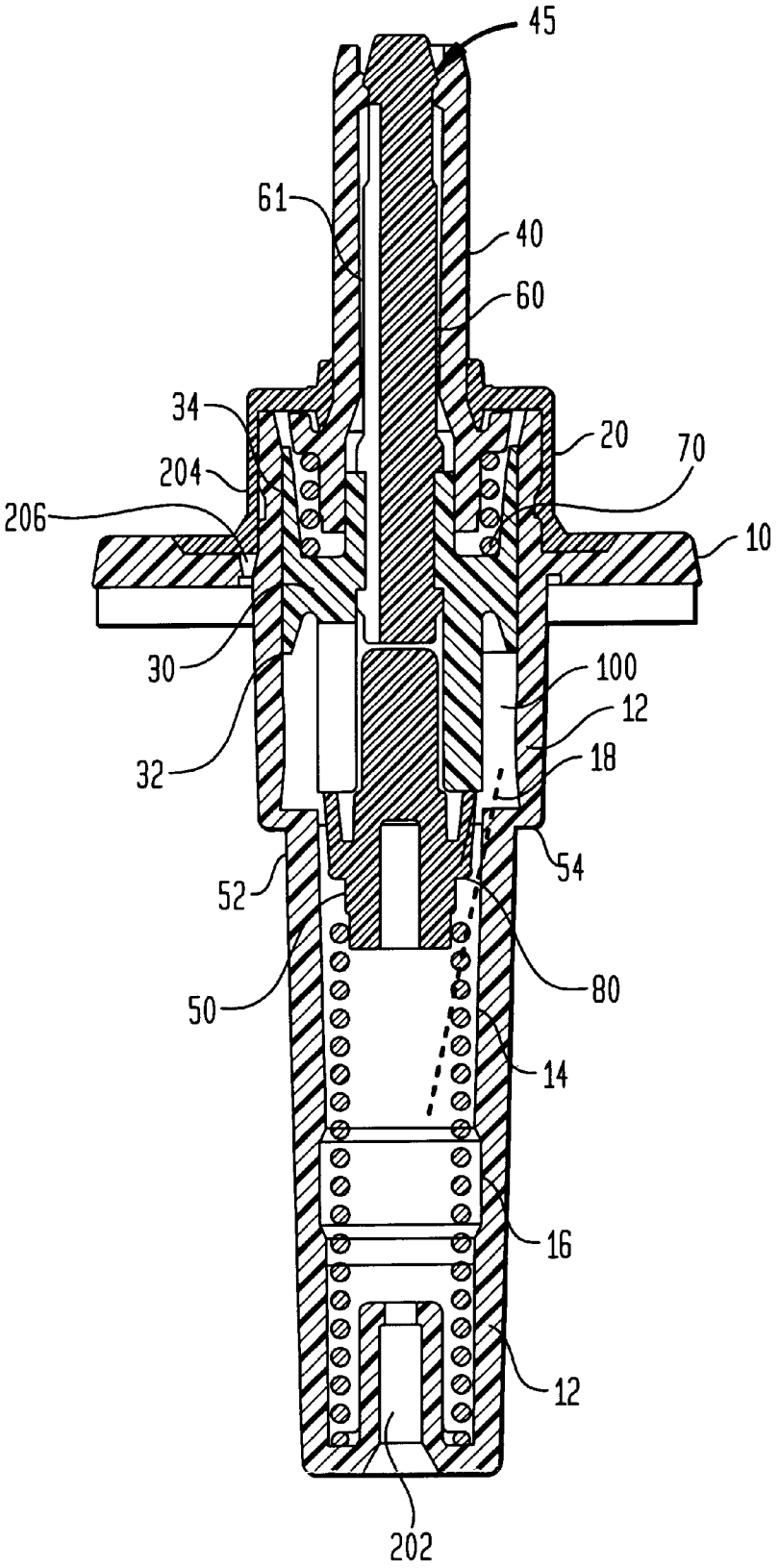
FIG. 1 is a cross-sectional view of a first inventive embodiment of a dispenser shown in rest position prior to use.

Referring first to FIG. 1, the dispenser has a body 10 which has a larger upper main hollow cylinder 12 and a smaller lower hollow cylinder 14. Cylinder 14 terminates at its upper end in an enlarged hollow cylinder 18. Cylinder 18 is disposed within and spaced from the lower end of cylinder 12. Cylinder 14 intermediate its ends has an enlarged hollow cylindrical region 16 disposed axially below cylinder 18.

A main piston 30 is disposed within and slidably engages the inner surface of cylinder 12 and forms a seal with its lower sealing periphery 32 and an upper sealing periphery 34. Piston 30 has a lower coaxial extension terminating in ledge 36. Piston 30 has a central bore in which the lower portion of central stem 60 is disposed and permanently attached. A collar 20 covers and receives the upper outwardly flaring upper end of cylinder 12.

The stem 40 is mounted coaxially with and surrounds the central stem 60. The enlarged upper end of the stem 60 engages a corresponding recess in the stem 40 forming outlet sealing surfaces 45. Stem 60 is biased away from the piston 30 by a spring 70 which forces surfaces 45 into a sealing engagement with the dispenser is at rest.

When the dispenser is dispensing position, head 45 is raised above the upper end of stem 40 and fluid flows upward along groove 61 and out of the upper end of hollow stem 40. The collar has a central opening through which stem 40 extends.

An inner piston 50 has a lower portion having an upper ledge 54 which is disposed axially with cylinder 14. Piston 50 has an upper portion extending axially within body 10. Piston 50 is biased toward main piston 30 by spring 80. Ledge 36 positions piston 50 and cooperates with ledge 54 to oppose the biasing action of spring 80. Thus ledge 54 of the inner piston rests against ledge 36 of the main piston when the liquid does not force them apart. Piston 50 has a sealing periphery 52 which is capable of forming a liquid tight seal with cylinder 14 but the seal is broken when it is aligned with enlargement 16 or cylinder 18.

An upper or main pump volume 100 is formed between cylinder 12 and main piston 30 while a lower pump volume 110 is formed between cylinder 14 and piston 50. When at rest, seal 52 of piston 50 is aligned with but spaced apart from cylinder 18, and volumes 100 and 110 communicate with each other.

In normal operation, both volumes are each filled with a fixed volume of fluid. As is conventional, the dispenser must first be primed.

The collar may incorporate slots 204 which form air passages. The collar with body attached is fitted to the neck of a container of fluid. The lower end of cylinder 14 has a central opening 202 which is raised above the remainder of this lower end as shown or if desired can be lowered below this remainder. A vertical dip tube can be fitted into the raised opening extending upward from the fluid into the lower end of the cylinder with the upper end of the tube engaging opening 202.

Figure 2:
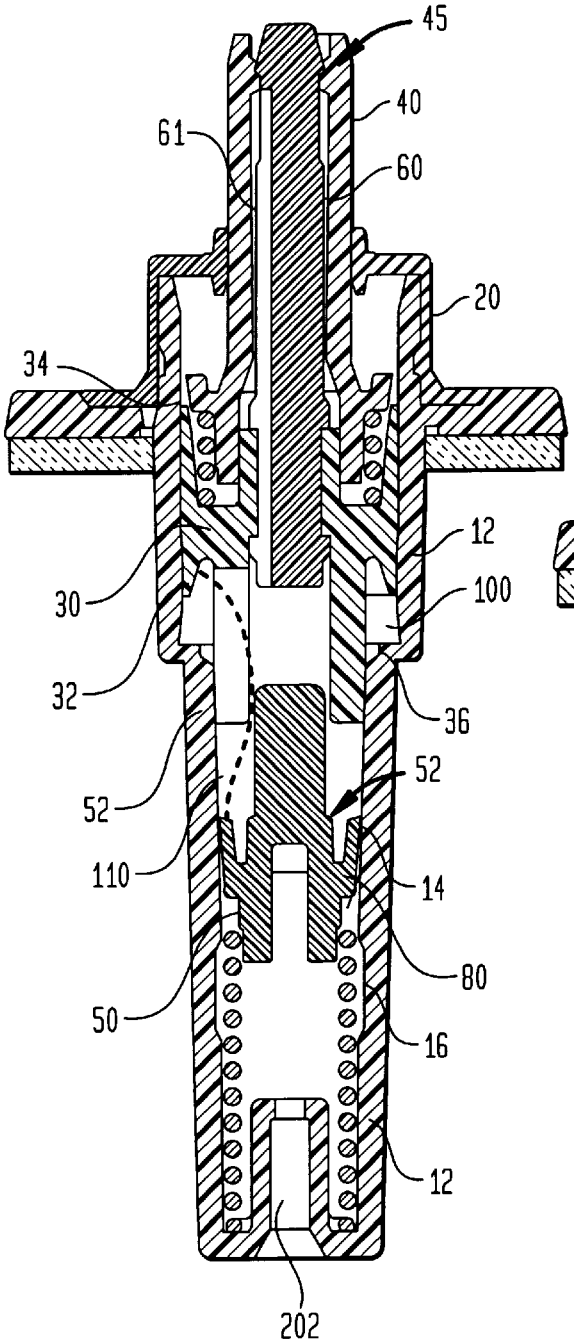
FIG. 2 is a cross-sectional view of the dispenser of FIG. 1 after activation of a down stroke illustrating the transfer of fluid from the upper volume to the lower volume.

When a user initiates a down stroke, as shown in FIG. 2, the outer stem 40 is pushed downward. [The dispenser will operate in any orientation, but for convenience, descriptions of locations up and down conform to the orientation shown in the figures]. The downward force on stem 40 pushes main piston 30 and the inner piston 50 downward until the sealing periphery 52 of piston 50 engages and forms a seal with cylinder 14. As a result, a fixed volume of fluid is trapped within volumes 100 and 110.

Continuation of the downward motion causes reduction of volume 100 and expansion of volume 110. Since the fluid is incompressible, fluid is transferred from volume 100 to volume 110. This action moves the inner piston 50 downward along the vertical axis at a displacement greater than that of piston 30.

Since cylinder 14 is smaller than cylinder 12, the separation between the inner piston and the main piston increases in proportion to the ratio of the squares of the diameters of cylinders 12 and 14. For example, if the cylinder 12 is twice as large as the cylinder 14, the inner piston will travel four times further than the piston 30.

Figure 3:
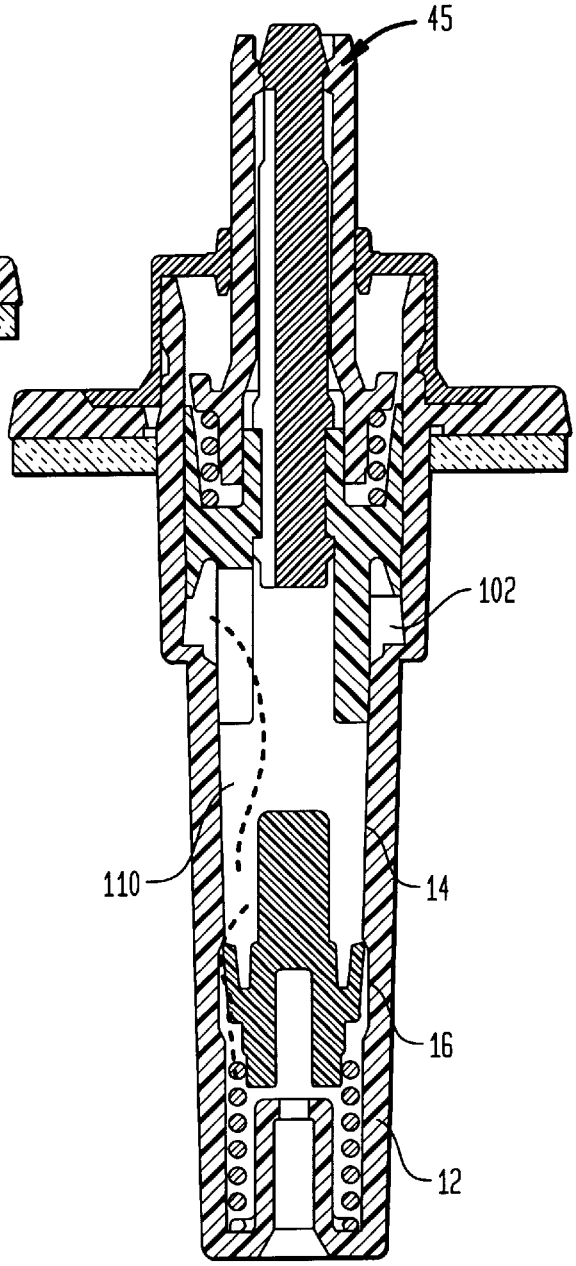
FIG. 3 is a cross-sectional view of the dispenser of FIG. 1 after the down stroke has reached the position to initiate fluid dispensing action.

When the sealing periphery 52 of piston 50 reaches enlargement 16, the seal is lost as shown in FIG. 3. As a result, while volume 100 continues to be reduced, volume 110 is not increased.

When main piston 50 has descended to the lower end of cylinder 12, its further motion is stopped. Stem 60 being rigidly connected to piston 50 also cannot move. However, outer stem 40 continues to move downward and head 45 is separated from stem 40 whereby the discharge value is opened. At this point, spring 80 forces inner piston 50 upwards out of enlargement 16 until its sealing periphery engages cylinder 14.

Figure 4:
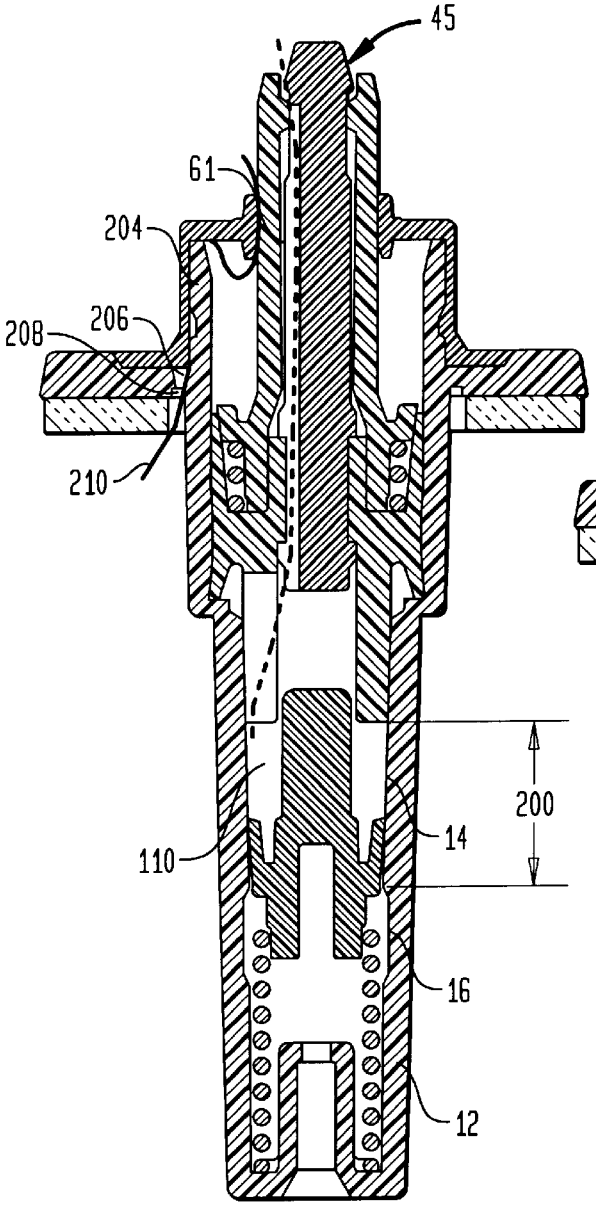
FIG. 4 is a cross-sectional view of the embodiment of FIG. 1 illustrating the positions of the components as the fluid is dispensed.
Figure 5:
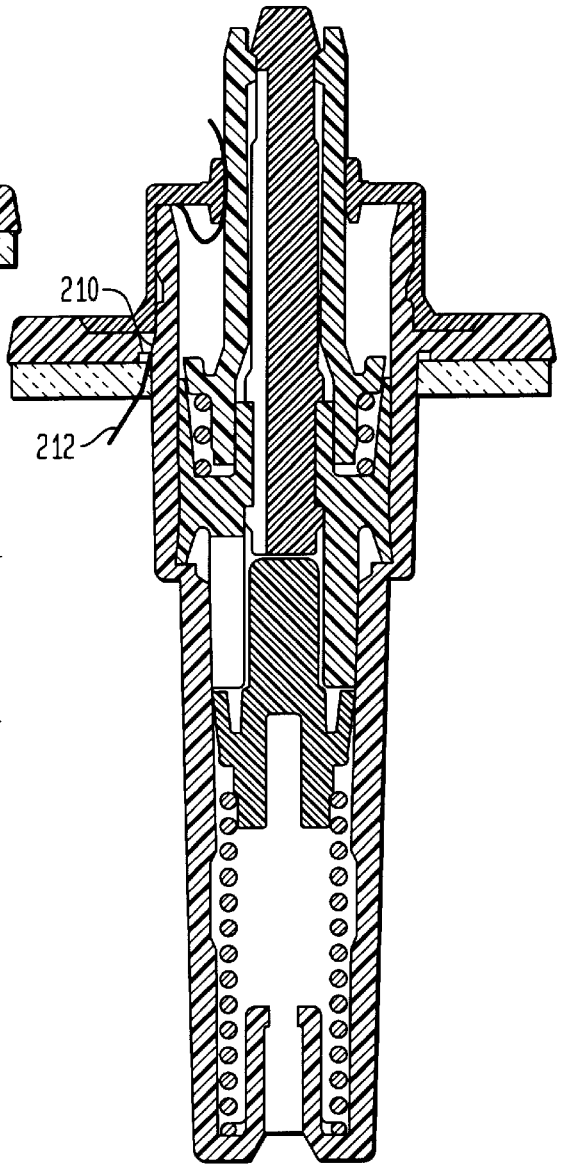
FIG. 5 is a cross-sectional view of the embodiment of FIG. 1 illustrating the positions of components at completion of dispensing.

As shown in FIG. 4, the fluid in volume 110 is dispensed upward via groove 61 and outward through the outlet valve. The continued upward movement of piston 50 continues as shown at 200 until its ledge 54 reaches a main piston surface 36. When the user releases the downward force onto the stem 40, spring 70 returns main piston 50 and stem 60 to their original quiescent positions. This action closes valve 45 as illustrated in FIG. 5.

At this point, inner piston 30, main piston 50, stem 40 and stem 60 move upward together. This movement causes the volume of pump chamber 110 to increase since the fluid in chamber 110 has been discharged as the fluid is dispensed. A partial vacuum is formed in the chamber as its volume increases. This process continues until the sealing periphery 52 of piston 30 leaves cylinder 14 and enters within but is spaced from cylinder 18.

A fluid conduction path is established between the fluid in the container via a dip tube and the two connected pump volumes 100 and 110. Because of the partial vacuum, a suction is created and the fluid is pulled upward from the container and fills both volumes.

The volume of fluid dispensed is equal by the product of the area defined by the body diameter 250 and the length 200. The pump dispensing accuracy is determined solely by these two parameters. Any other manufacturing or dimensional variability cannot influence the accuracy of the dose.

Referring now to FIGS. 6 and 6*a*, 6*b*, and 6*c*, the dispenser body 10 has a smaller main cylinder 12 and a larger lower cylinder 14. Cylinder 14 terminates in a lower enlarged area 16. Cylinder 14 has a second upper enlarged area 18 integral with cylinder 12. A collar 20 closed the upper open end of the body.

A main piston 30 is axially disposed within cylinder 12 and forms a continuous seal via its sealing peripheries with cylinder 12.

An inner piston 50 is axially disposed within cylinder 14. Piston 50 is biased toward piston 30 by spring 80. Piston 50 has a sealing periphery which forms a tight seal with cylinder 14, but loses its seal when it is aligned either with cylinder 16 or enlargement 18. A pump chamber is formed between cylinder 12 and piston 30. During normal operation, after the dispenser has been primed, this pump chamber is filled with a fixed volume of liquid. Optionally, cylinder 18 can have an insert 92 with a central opening to receive a dip tube.

The dispenser is actuated by pushing the pistons 30 and 50 against the force of spring 80. Since piston 50 is biased against piston 30, the outlet port 45 remains closed and both pistons travel downward together. As the pistons are displaced by the user from their normal unactuated positions to the arrangement shown in FIG. 6*a*. The volume 100 of the pump chamber expands since the cross sectional area of cylinder 14 is now larger than the cross sectional area of cylinder 12. This is the suction stroke. As piston 50 descends , sealing periphery 52 enters the enlarged area 16, and volume 100 is filled with fluid.

When the user releases the downward force on piston 30, spring 80 acts to force the pistons to their unactuated positions. This is the compression stroke. When sealing periphery engages cylinder 14, the seal is made, trapping a given volume of fluid in volume 100. Since the fluid is incompressible, the trapped fluid forces piston 30 away from piston 50 and the outlet port 45 opens. The dispensing stroke begins with fluid path 132 shown in FIG. 6*b*. The volume of fluid discharged is proportional to the diameter 250 and length 200 of cylinder 14.

Figure 6:
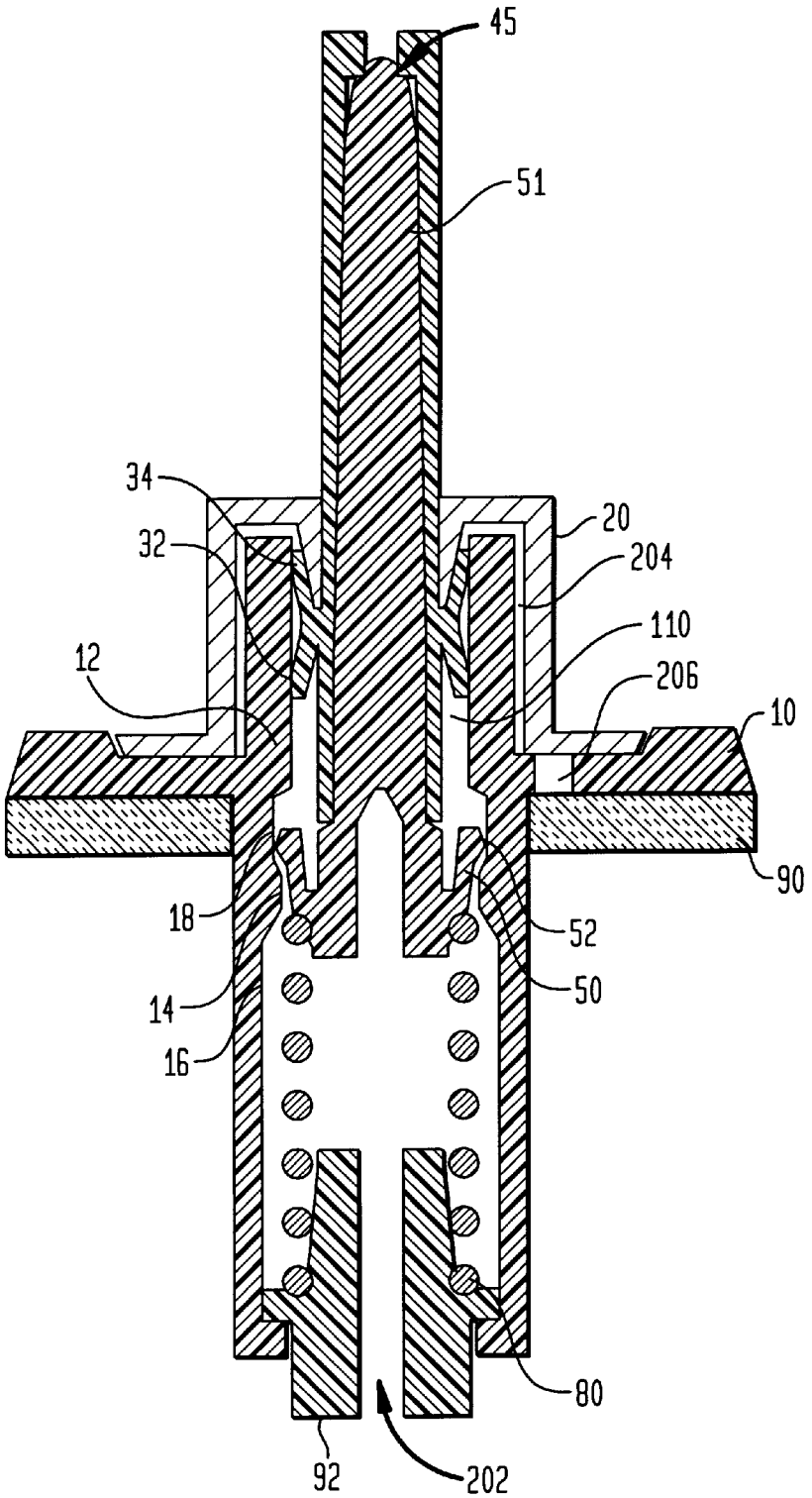
FIG. 6 is a cross-sectional view of a second embodiment of the invention shown in rest position.
Figure 6A:
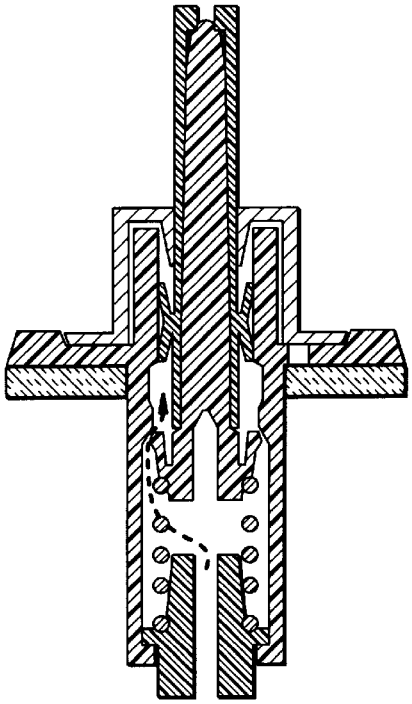
FIGS. 6*a*, 6*b* and 6*c* are cross-sectional views illustrating different steps in the operation of the second embodiment.
Figure 6B:
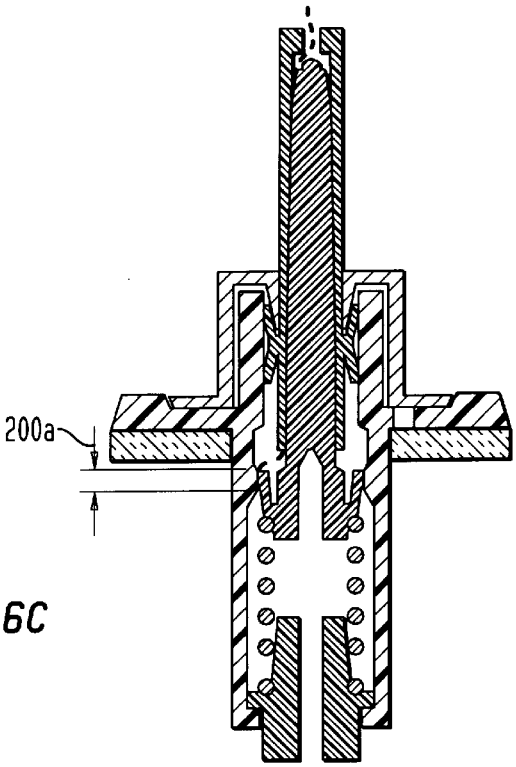
Figure 6C:
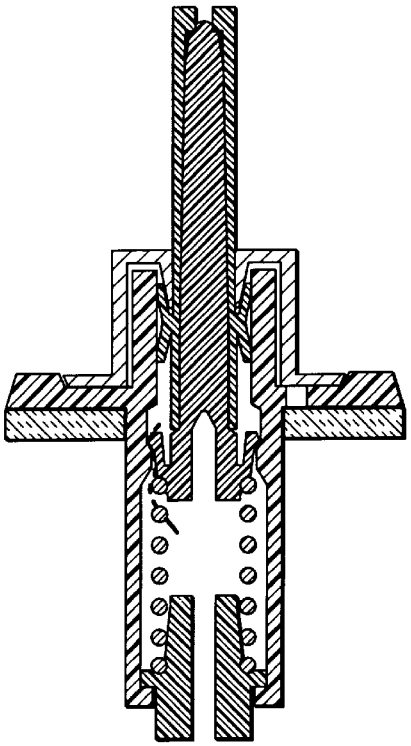

This stroke continues until sealing periphery enters area 18, and the seal is again broken as shown in FIG. 6*c*. This action immediately reduces the fluid pressure, closing port 45. A small amount of excess fluid that remains in volume 102 escapes via path 122 and is returned to the container.

Volume 100 is defined by the larger cylinder, volume 110 by the smaller cylinder. Volume 100 is always larger than volume 110 and volume 102 is equal to the volume difference between 100 and 110.

Since the fluid discharge is produced during the compression or return stroke, any variation in initiating the down or suction stroke cannot influence the amount of discharge and the accuracy of dosage measurement is correspondingly enhanced.

While the invention has been described with particular reference to the drawings and detailed description, the protection solicited is to be limited only by the terms of the claims which follow.

What is claimed is:

1. A metered output fluid dispenser adapted for connection to a container of fluid to receive fluid therefrom, said dispenser having a rest position at which fluid does not flow into the dispenser, said dispenser being adapted to discharge fluid during a selected section of a stroke which produces fluid discharge, said dispenser comprising:

a vertical hollow elongated body having a first hollow cylinder having a first diameter and an integral section defining a second hollow cylinder having a second and different diameter, said second cylinder having upper and lower spaced apart enlargements defining therebetween a selected portion of the second cylinder, said second cylinder having an opening below the lower enlargement through which fluid can flow into the dispenser from the container;

a first piston slidable through the length of the first cylinder and remaining in continuous sealing relationship engagement with the inner wall of the first cylinder;

a second piston slidable through the second cylinder, said second piston when traversing said selected section being in sealing engagement therewith allowing the dispenser to dispense fluid, said second piston when aligned with either one of said enlargements being out of sealing engagement therewith and preventing the dispenser from discharging fluid; said second cylinder being aligned with the upper enlargement when the dispenser is in rest position, the second cylinder when aligned with the lower engagement allowing charging fluid to flow therethrough.

2. The dispenser of claim 1 wherein the first cylinder and the first piston are larger than the second piston and second cylinder respectively; a first pump volume is formed between the first cylinder and first piston; a second pump volume is formed between the second cylinder and the second piston; and fluid is dispensed during a portion of a down stroke.

3. The dispenser of claim 1 wherein the second cylinder and second piston are larger than the first cylinder and second piston respectively; a first pump volume is formed between the second cylinder and second piston; a second pump volume is formed between the first cylinder and the first piston; and fluid is dispensed during a portion of an up stroke.

4. The dispenser of claim 2 wherein the down stroke is performed while the pistons are displaced from their positions at rest and fluid is dispensed and wherein a biasing member automatically returns the pistons to their rest positions while fluid is not dispensed during a subsequent up stroke.

5. The dispenser of claim 3 wherein the down stroke is performed while pistons are displaced from their positions at rest and fluid is not dispensed and wherein a biasing member returns automatically returns the pistons to their rest positions while fluid is dispensed during a subsequent up stroke.

* * * * *